US011185729B2

(12) United States Patent
Pasterino et al.

(10) Patent No.: US 11,185,729 B2
(45) Date of Patent: Nov. 30, 2021

(54) LOWER BODY EXERCISE DEVICE

(71) Applicant: Pvolve, LLC, New York, NY (US)

(72) Inventors: Stephen Pasterino, New York, NY (US); Stephanie Wineman, Birmingham, MI (US)

(73) Assignee: Pvolve, LLC, New York, NY (US)

( * ) Notice: Subject to any disclaimer, the term of this patent is extended or adjusted under 35 U.S.C. 154(b) by 0 days.

(21) Appl. No.: 16/993,839

(22) Filed: Aug. 14, 2020

(65) Prior Publication Data

US 2020/0368571 A1 Nov. 26, 2020

Related U.S. Application Data

(63) Continuation-in-part of application No. 16/557,339, filed on Aug. 30, 2019, which is a (Continued)

(51) Int. Cl.
*A63B 21/055* (2006.01)
*A63B 23/04* (2006.01)
(Continued)

(52) U.S. Cl.
CPC ..... *A63B 21/0552* (2013.01); *A63B 21/04* (2013.01); *A63B 21/4011* (2015.10); *A63B 23/04* (2013.01)

(58) Field of Classification Search
CPC ..... A63B 21/028; A63B 21/04; A63B 21/05; A63B 21/00189; A63B 21/02–0557; A63B 23/0488; A63B 2071/1233–1283
See application file for complete search history.

(56) References Cited

U.S. PATENT DOCUMENTS 4,726,357 A * 2/1988 DeStefano ..... A61H 31/007 473/596
4,805,605 A * 2/1989 Glassman ..... A61F 5/0193 128/882

(Continued)

FOREIGN PATENT DOCUMENTS

FR 3080296 A1 10/2019

OTHER PUBLICATIONS

Christie, Christina, "Pelvicore Training with Christina Christie PT, CCE, FAFS, FMR", uploaded to YouTube on Jul. 29. 2012. hitos://www.voutube.com/waich?v=:wM9J-iPnT5U. 59 Daaes of screenshots. (Year: 2012).*

(Continued)

*Primary Examiner* — Nyca T Nguyen
(74) *Attorney, Agent, or Firm* — Foley & Lardner LLP

(57) ABSTRACT

An exercise device includes a resilient compression member configured to be placed between inner thighs of a user and resist a compressive force from the user, and a resilient tension member comprising a grip component configured to hold the resilient tension member in place on outer thighs of the user. The resilient tension member is configured to couple to opposing sides of the compression member, form a first portion of a loop around the compression member and the outer thighs of the user, and resist a tensile force from the user. The exercise device further includes an extension member configured to connect with opposing ends of the tension member to form a second portion of the loop.

20 Claims, 17 Drawing Sheets

Related U.S. Application Data continuation-in-part of application No. 16/185,468, filed on Nov. 9, 2018, now Pat. No. 10,398,922.

(51) Int. Cl.
*A63B 21/04* (2006.01)
*A63B 21/00* (2006.01)

(56) References Cited

U.S. PATENT DOCUMENTS 4,830,366 A * 5/1989 Ruden ..... A63B 21/028 482/122
4,909,051 A * 3/1990 Lee ..... E05B 75/00 128/878
4,909,054 A 3/1990 Fox
5,230,682 A * 7/1993 Myers ..... A63B 21/0004 473/576
5,242,348 A * 9/1993 Bates ..... A63B 21/0004 482/105
5,735,776 A 4/1998 Swezey et al.
5,945,060 A * 8/1999 Williams ..... A63B 21/0004 264/150
6,179,756 B1 * 1/2001 Bertolucci ..... A63B 21/0023 482/131
D438,624 S 3/2001 Reina
D498,799 S * 11/2004 Kerry ..... A63B 21/0602 D21/662
7,223,217 B1 * 5/2007 Liao ..... A63B 21/0004 482/122
D552,696 S * 10/2007 Hallar ..... A63B 21/00185 D21/662
7,326,122 B2 * 2/2008 Park ..... A63B 21/06 473/256
9,033,855 B2 5/2015 Opfer
9,545,534 B2 1/2017 Crandall
9,616,272 B1 * 4/2017 Bennett ..... A63B 21/0602
10,322,311 B2 * 6/2019 Naomi ..... A63B 21/002
2004/0198570 A1 * 10/2004 Tangios ..... A63B 23/0488 482/111
2005/0079963 A1 * 4/2005 Lin ..... A63B 21/00185 482/126
2006/0217248 A1 * 9/2006 Diseati ..... A63B 21/028 482/128
2007/0066457 A1 * 3/2007 Abranchess ..... A63B 69/0079 482/121
2010/0183814 A1 * 7/2010 Rios ..... A63B 60/00 427/387
2011/0251531 A1 * 10/2011 Johnson ..... A63B 21/0023 601/5
2012/0004079 A1 * 1/2012 Hyacinth ..... A63B 69/0059 482/92
2012/0108403 A1 5/2012 Zandman-Zeman
2012/0149536 A1 6/2012 Trimble et al.
2013/0085045 A1 4/2013 Chavez et al.
2015/0174442 A1 * 6/2015 Inzer ..... A63B 71/1225 482/93
2017/0361173 A1 12/2017 Buenning
2018/0008875 A1 * 1/2018 Frank ..... A63B 31/12
2018/0318630 A1 * 11/2018 Young ..... A63B 21/00058
2019/0259299 A1 * 8/2019 Jewelewicz ..... A63B 21/4025
2019/0351278 A1 * 11/2019 Walker ..... A63B 21/00043
2020/0147443 A1 * 5/2020 Pasterino ..... A63B 21/0555
2020/0230456 A1 * 7/2020 Hunter ..... A63B 21/0555

OTHER PUBLICATIONS

International Search Report and Written Opinion on International Application No. PCT/US2020/048397, dated Oct. 5, 2020, 12 pages.

* cited by examiner

LOWER BODY EXERCISE DEVICE

CROSS-REFERENCE TO RELATED PATENT APPLICATIONS

This application is a continuation-in-part of U.S. patent application Ser. No. 16/557,339, filed on Aug. 30, 2019, which is a continuation-in-part of U.S. patent application Ser. No. 16/185,468 filed on Nov. 9, 2018, all of which are incorporated herein by reference in their entireties.

BACKGROUND

The present disclosure relates generally to exercise devices for exercising the lower body of a user. More particularly, the present disclosure relates to an exercise device in which a user can use resistance training to exercise different lower body muscles by applying tensile and compressive forces to the exercise device. This type of training may allow the user to strengthen and tone targeted muscles of his or her lower body without building bulky muscles.

Many exercise devices enable a user to exercise by applying a force in reaction to a resistive force produced by the device. In one type of device, the resistive force acts only in one direction. The disadvantage of these types of devices is that the user can only exert a force in one direction against the resistive force, and therefore only a single set of muscles can be exercised at any one time.

Traditional lower body workout equipment is either intended to increase the size or "bulkiness" of lower body muscles of the user or is difficult for the user to properly use to obtain the results that the user desires. For example, to obtain certain results, a user that trains using free weights must be familiar with proper weight-training techniques to target specific muscles or muscle areas and further be knowledgeable of the proper size of weights to use. Using improper techniques and equipment can result in injury or other unintended results, such as unintentionally increasing the size of certain muscles or training non-targeted muscles.

SUMMARY

One embodiment relates to an exercise device. The exercise device includes a resilient compression member, a resilient tension member, and an extension member. The resilient compression member is configured to be placed between inner thighs of a user and resist a compressive force from the user. The resilient tension member includes a grip component configured to hold the resilient tension member in place on outer thighs of the user. The resilient tension member is configured to couple to opposing sides of the compression member, form a first portion of a loop around the compression member and the outer thighs of the user, and resist a tensile force from the user. The extension member is configured to connect with opposing ends of the tension member to form a second portion of the loop.

Another embodiment relates to an exercise device. The exercise device includes a resilient compression member and a resilient tension member. The resilient compression member is configured to resist a compressive force from a user. The resilient tension member includes a grip component configured to hold the resilient tension member in place on the user. The resilient tension member is configured to couple to opposing sides of the compression member, form a loop around the compression member and the user, and resist a tensile force from the user.

Another embodiment relates to an exercise device. The exercise device includes a resilient compression member and a resilient tension member. The resilient compression member is configured to resist a compressive force from a user and includes a compressible object having a rounded or sphere-like shape. The resilient tension member includes a grip component having two or more grip elements spanning at least most of the length of the resilient tension member and being configured to hold the resilient tension member in place on the user. Each grip element has a wave shape. The resilient tension member is configured to couple to the compression member, form a loop around the compression member and the user, and resist a tensile force from the user.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Figure 1:
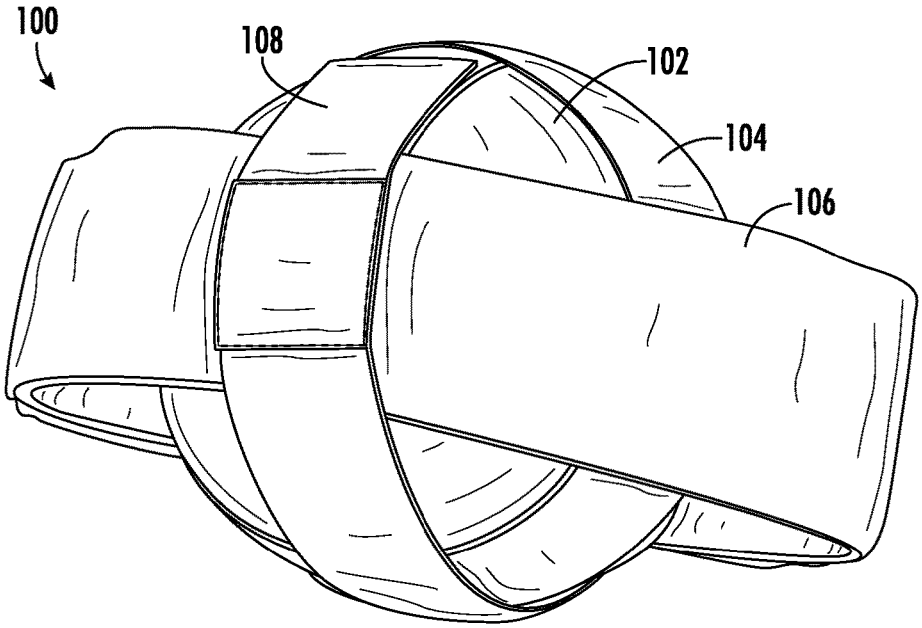
FIG. 1 is a perspective view of an exercise device, according to an exemplary embodiment.

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the figures, an exercise device is shown accordingly to exemplary embodiments. The exercise device can be used by a user to exercise a lower body of the user. The exercise device includes a resilient compression member, and a resilient tension member connected to opposite surfaces of the compression member by strap members looped over the compression member. The user can place his or her legs substantially on opposite sides (e.g., on opposing surfaces, on two points that are antipodal to one another) of the compression member between the compression member and the tension member.

When the legs of the user exert inwardly directing compressive forces against the compression member, the compression member produces outwardly directed resistive forces in reaction to the inwardly directed forces exerted by the legs of the user. When the legs of the user exert outwardly directed forces on the tension member, the tension member stretches and in turn produces inwardly directed resistive forces in reaction to the outwardly directed forces exerted by the legs of the user. In a given exercise routine, the user can exercise different sets of muscles of the legs by alternately exerting compressive and tensile forces on the compression member and the tension member, respectively.

In some embodiments, the exercise device may be constructed of an inflatable ball with a resistance band attached to the inflatable ball. The resistance band may act as a strap on both sides of the inflatable ball which can hold the inflatable ball in place when the legs of the user are put between the inflatable ball and the resistance band. The inflatable ball may be positioned all the way into the upper thighs as high as the user is able. The resistance band may then be wrapped around the upper thighs of the user close to their hips. From this position, the user can perform various lower body exercises.

The inflatable ball can be consciously and unconsciously compressed by the user using their inner thighs, hips, and gluteals through most of the exercises. Through the use of various exercises performed at different angles, all parts of the inner thigh and gluteals of the user may be engaged differently. All the movements that engage the inflatable ball can be done through adduction of the hips and the legs creating a resistance against the inflatable ball and activating all the muscles that make up the inner thing and the gluteals. The inflatable ball may also be held in the user's hands to either squeeze or resist a compressive force. Exercises performed by the user with the inflatable ball held in the hands can engage the user's upper body and lower abs.

The resistance band may hold the inflatable ball in place between the legs of the user and may be used in all exercises involving abduction of their legs and hips. For example, the resistance band can be engaged by creating opposing force when the user does at least one of step patterns, leg lifts, and squats, all of which activate the muscles on the outer thighs and the gluteals.

The exercise device is different than other inner thigh apparatuses because it is positioned all the way up on the inner thighs of the user, while other inner thigh apparatuses are generally placed down by a user's knees. The exercise device includes resistance for both adduction and abduction exercises. A user performing a workout may include both adduction and abduction exercises to add different dynamics to their workout.

The exercise device can be used in various types of workouts and with different methods of exercise for both men and women. The exercise device may be especially effective for woman due to an effect on strengthening a pelvic floor, toning the inner thighs, and tightening and lifting of the gluteals which are considered hard-to-reach parts of a body for women.

Also, many other exercise devices only prompt reaction when applying force. The exercise device of the present disclosure includes a compression member placed specifically on the inner thighs of the user, which creates a reaction from a certain set of muscles as a result of the mere presence of the compression member, thus prompting muscle activation though proprioceptive and force reaction training.

Figure 2:
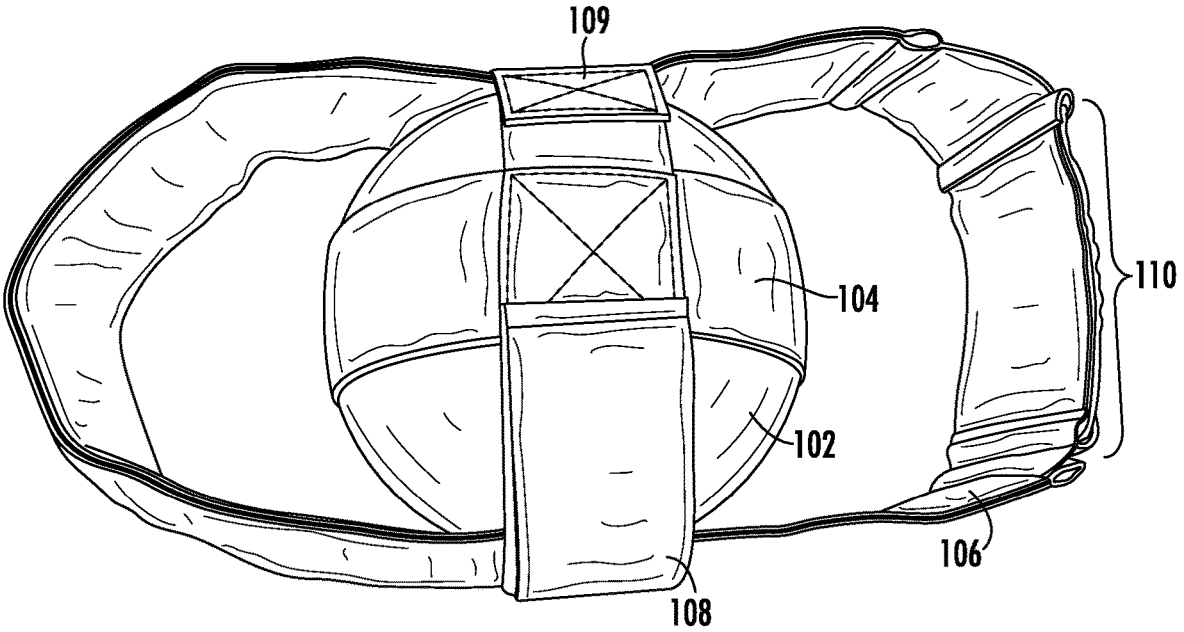
FIG. 2 is a top view of the exercise device of FIG. 1.

Referring now to FIGS. 1-2, various views of an exercise device 100 are shown, according to an exemplary embodiment. Specifically, FIG. 1 is a perspective view of the exercise device 100, and FIG. 2 is a top view of the exercise device 100. The exercise device 100 is shown to include a compression member 102, a tension member 106, an extension member 110, and strap members 104, 108, and 109.

The compression member 102 may be constructed out of any deformable and resilient materials that possess the inherent characteristics of being capable of resisting a compressive force applied by a user. The compression member 102 may be configured to be placed between inner thighs of the user during an exercise. The user may use his or her inner thighs and gluteals to apply the compressive force (e.g., compress, squeeze) to the compression member 102 during an exercise. The compression member 102 can be resilient enough to repeatedly return to an original size and an original shape when the compressive force is removed. Another way to state this property is that the compression member 102 has a "memory".

For example, the compression member 102 may be an inflatable member. The inflatable member may include a substantial portion of void space within an interior of the inflatable member. The void space may permit the user to compress the inflatable member and to inflate the inflatable member using an air pump or any other appropriate inflation device. The inflatable member may be uninflated before the user puts on the exercise device 100 and/or while the user is wearing the exercise device 100. The inflatable member may be configured to be inflated to various states of compressibility. For example, the user may inflate the inflatable member to one of the various states of compressibility to increase or decrease the resistance to compressive forces.

As shown in the figures, the compression member 102 can be a ball or be sphere-shaped, though it will be appreciated that other types of compressionable objects can be used, such as other compressionable objects having a rounded or sphere-like shape, an object with edges or corners, or a solid or substantially solid object (e.g., an object made of foam or other material).

Additionally, the compression member 102 may be configured to accommodate additional exercise equipment. For example, the compression member 102 may include one or more components on an outer surface thereof configured to accommodate one end of a resistance band, with a first end of the resistance band coupling to the component on the surface of the compression member 102 and the second end of the resistance band including a handle that may be grasped by the user. Further to the previous example, the outer surface of the compression member 102 may include one or more rigid looped structures, for example, configured to secure an end of a resistance band. In some embodiments, the outer surface of the compression member 102 may have multiple structures configured to couple to a resistance band. If the compression member 102 is a spherical, ball-shape, the outer surface of the compression member 102 may include a pair of the aforementioned structures substantially diametrically opposite one another. A pair of resistance bands having a first end and a second end may then be secured to the structures of the compression member 102 (e.g., one band per structure), with the first end of each of the bands secured to the structures and the second end of each of the bands having handles to be grasped by the user.

The tension member 106 may be a strap of material including elastomeric material coupled to opposing sides of the compression member 102 and configured to form a loop around the compression member 102 and outer thighs of the user. The tension member 106 may possess the inherent characteristics of being capable of resisting a tensile force applied by the user. The tension member 106 may be configured to be worn around outer thighs of the user during an exercise. The user may use his or her outer thighs to apply the tensile force (e.g., stretch, extend) to the tension member 106 during an exercise. The tension member 106 can be resilient enough to repeatedly return to an original size and an original shape when the tensile force is removed. Another way to state this property is that the tension member 106 has a "memory".

For example, the tension member 106 can include elastic, latex, or other stretchable material. In another example, the tension member 106 can include multiples layers of an elastic material and a latex material. For example, the tension member 106 can include two outer layers of an elastic material and at least one inner layer of latex. The tension member 106 may be in the range of about 24-36 inches in a relaxed or unstretched state. In some embodiments, the tension member 106 is substantially 30 inches in length in a relaxed or unstretched state. In some embodiments, the exercise device 100 may include multiple tension members 106 of different lengths that are selectable by the user.

For example, the tension member 106 may be a resistance band coupled to opposing sides of the compression member 102. The resistance band may act a strap that allows the user to hold the compression member 102 in place between his or her legs by wearing the resistance band around his or her outer thighs. The exercise device may or may not include the extension member 110 coupled to opposing ends of tension member 106. The extension member 110 may act as an extension to a length of the tension member 106. The user can decide whether or not to attach the extension member 110 to the tension member 106. The extension member 110 can be attached to the tension member 106 before the user puts the exercise device 100 on or after the user puts the exercise device 100 on by uncoupling the fasteners 116 and 118 of the tension member 106 and coupling the fasteners 116 and 118 of the extension member 110 to the fasteners 116 and 118 of the tension member 106, as discussed in greater detail below.

Additionally, the tension member 106 may be configured to be a solid (e.g., single-layer) resistance band. For example, rather than including multiple layers of a stretchable material, such as an elastic material and a latex material, the tension member 106 may include a single layer of stretchable material, such as a polyester, elastic, spandex, or other material with similar properties. Depending on the material of the single layer embodiment of the tension member 106, the length of the tension member 106 may vary. For example, the single layer tension member 106 may be configured to stretch less than a multiple layer tension member 106, and accordingly the single layer tension member 106 may have a longer standard length. In another example, the single layer tension member 106 may be configured to stretch more than the multiple layer tension member 106, and accordingly the single layer tension member 106 may have a shorter standard length. The single layer tension member 106 may also have a resistance rating greater to, less than, or the same as the multiple layer tension member 106.

The tension member 106 may be configured to have a specific level of resistance, and may be measured in a manner the same as or similar to other commonly used stretchable exercise equipment (e.g., 10 lbs of resistance, etc.). Accordingly, the exercise device 100 may be manipulated such that the tension member 106 may be replaced with another tension member 106 that is the same as and/or similar to the tension member 106. For example, after using the exercise device 100 and performing various exercises using a first tension member 106, a user may gain strength and desire a greater resistance than that offered by the first tension member 106. The user may elect to manipulate the exercise device 100 to replace the first tension member 106 with a second tension member 106 having a greater resistance rating (e.g., 20 lbs of resistance) than the first tension member 106. The user may then perform exercises using the exercise device 100 with the second tension member 106 having a greater resistance than that of the first tension member 106. In another example, a user may desire to perform exercises using the exercise device 100 using a third tension member 106 similar to the first tension member 106 that has a lower resistance rating (e.g., 5 lbs of resistance) than that of first the tension member 106. Similar to the previous example, the user may manipulate the exercise device 100 to replace the first tension member 106 with the third tension member 106 having a lower resistance but configured the same as and/or similar to the first tension member 106. The user may then perform exercises using the exercise device 100 with the third tension member 106 having a lower resistance than that of the first tension member 106. In some embodiments, the exercise device 100 may include multiple tension members 106 the same as and/or similar to the first tension member 106 to accommodate various levels of resistance desired by the user. The multiple tension members 106 as described previously may include resistance ratings greater than, less than, or the same as the tension member 106.

Figure 9:
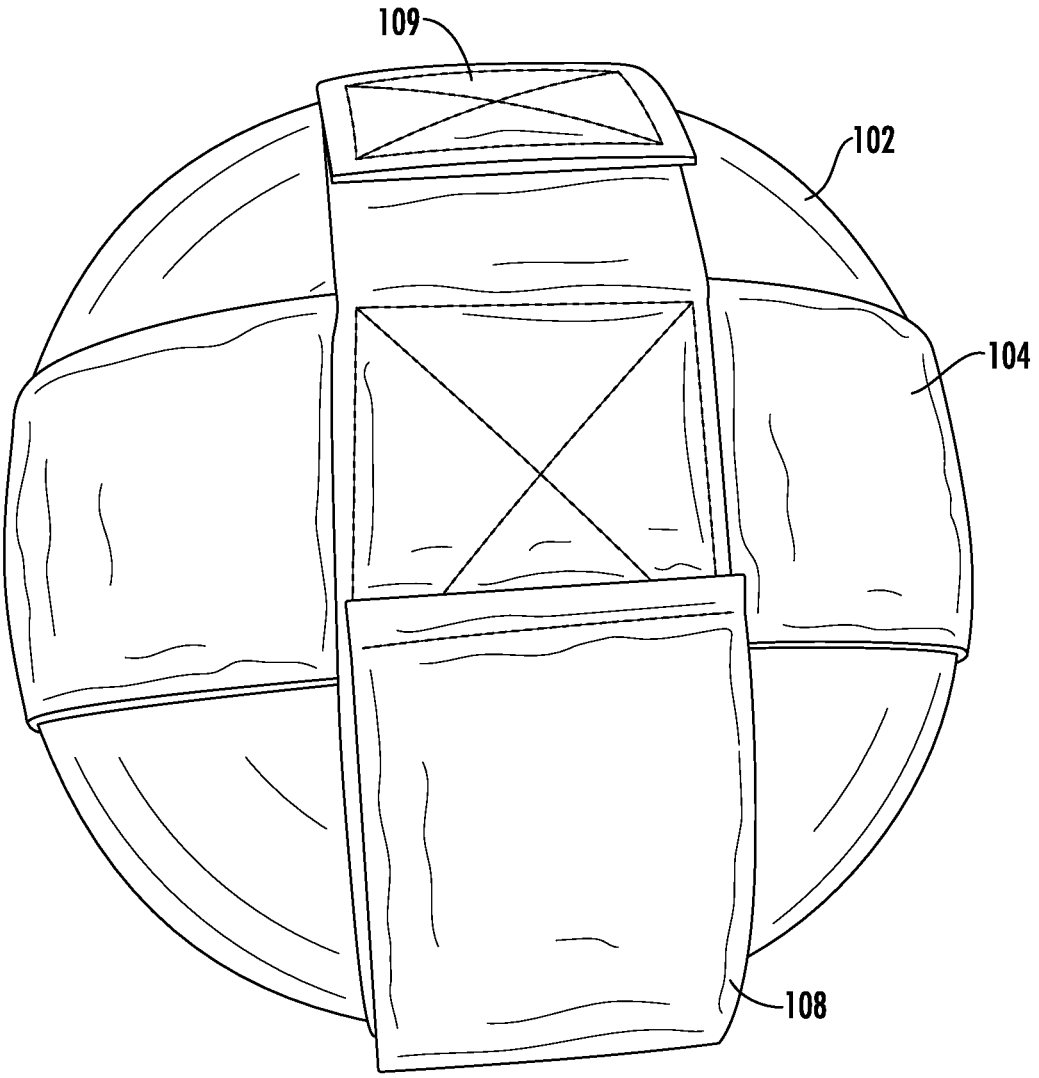
FIGS. 9-12 are views of the exercise device of FIG. 1 in various configurations.

The strap member 104 may be configured to receive and secure the compression member 102 in place. The strap members 108 and 109 may be coupled to the strap member 104 and configured to form a closed loop. The closed loop formed by the strap members 108 and 109 may be configured to receive and secure the tension member 106 to the compression member 102. The strap members 108 and 109 are configured to enable the tension member 106 to slide through the strap members 108 and 109 such that the tension member 106 can be completely removed from the strap members 108 and 109, as shown in FIG. 9.

Additionally, the strap member 104 may be configured so that the exercise device 100 can be used for various upper body exercises. For example, the strap member 104, and/or strap members 108 and 109 may include one or more looped members or sleeves on an outer portion thereof (e.g., opposite the side of the strap that interfaces with the compression member 102). For example, the looped members and/or sleeves may be configured on one or more of the straps such that the loops and/or sleeves are substantially diametrically opposite the compression member 102 from one another. A user may place one or more hands or arms in the one or more looped members and/or sleeves to position the compression member 102 between the hands or arms of the user, respectively. The looped members and/or sleeves of the exercise device 100 may be a material the same as and/or similar to the strap member 104 and/or the strap members 108 and 109. Additionally, the looped members and/or sleeves may be of a material the same as or similar to that of the tension member and having similar elastic qualities.

Figure 3:
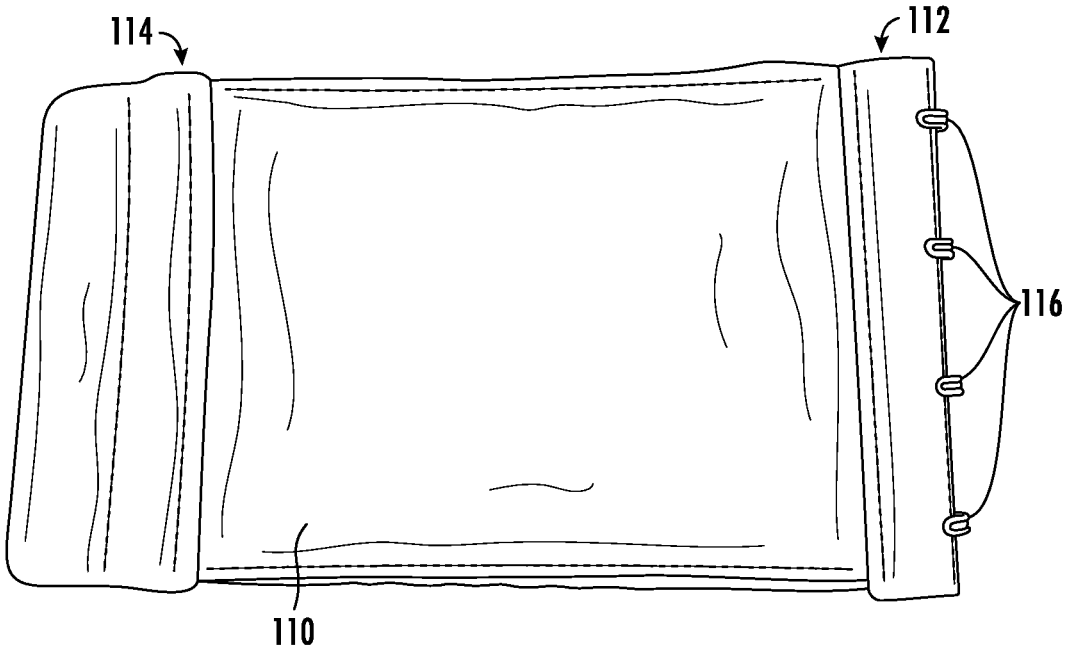
FIGS. 3-4 are close-up views of an extension of the exercise device of FIG. 1.
Figure 4:
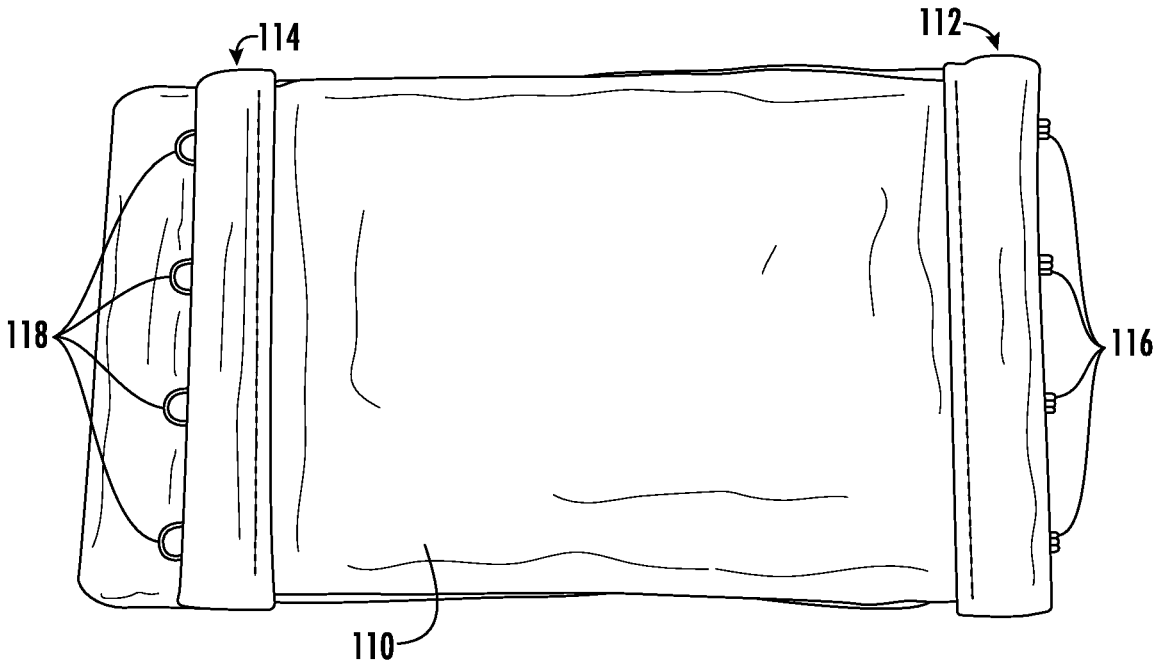

Referring now to FIGS. 3-4, close-up views of the extension member 110 are shown, according to some embodiments. The exercise device 100 may or may not include the extension member 110 coupled to opposing ends of tension member 106. The extension member 110 may be constructed of a same or similar material as the tension member 106 and may act as an extension to a length of the tension member 106. The user can decide whether or not to attach the extension member 110 to the tension member 106. For example, if the user is unable to wear the exercise device properly because a size of the loop formed by the tension member 106 is too small for the legs of the user, the user may choose to attach the extension member 110 to the ends of the tension member 106 to increase the size of the loop formed by the tension member 106.

The extension member 110 can be resilient enough to repeatedly return to an original size and an original shape when a tensile force is applied and removed. Another way to state this property, is that the extension member 110 has a "memory". For example, the extension member 110 can include elastic, latex, or other stretchable material. In another example, the extension member 110 can include multiples layers of elastic and latex. For example, the extension member 110 can include two outer layers of an elastic material and at least one inner layer of latex. The extension member 110 may be in the range of about 3-8 inches in a relaxed or unstretched state. In some embodiments the extension member 110 is substantially 5 inches in length in a relaxed or unstretched state. In some embodiments, the exercise device 100 may include multiple extension members 110 of different lengths that are selectable by the user.

The extension member 110 is shown to include connections 112 and 114 and fasteners 116 and 118. The connection 112 may include one or more fasteners 116 configured to couple to a first end of the tension member 106. The connection 114 may include one or more fasteners 118 configured to couple to a second end of the tension member 106. The fasteners 116 and 118 may be various types of fasteners (e.g., hook-and-loop, buckle, zipper, hook-and-eye). For example, as shown in FIGS. 3-4, the fasteners 116 and 118 are shown to be hook-and-eye fasteners, where the one or more fasteners 116 are shown to be the hooks and the one or more fasteners 118 are shown to be the eyes. The fasteners 116 and 118 may be constructed from a wide range of materials (e.g., metal, plastic) that possess inherit characteristics that resist deformation under a tensile force. The fasteners 116 and 118 are capable of maintaining an original shape, so as to not deform and uncouple from other fasteners.

Figure 5:
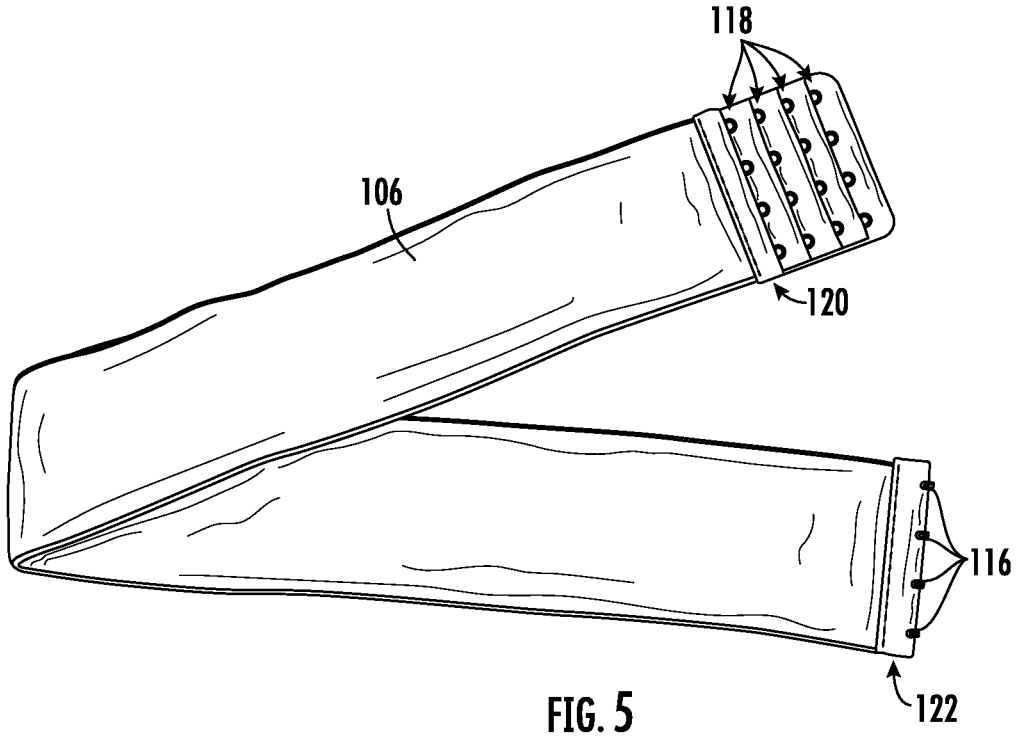
FIGS. 5-6 are close-up views of a tension member of the exercise device of FIG. 1.
Figure 6:
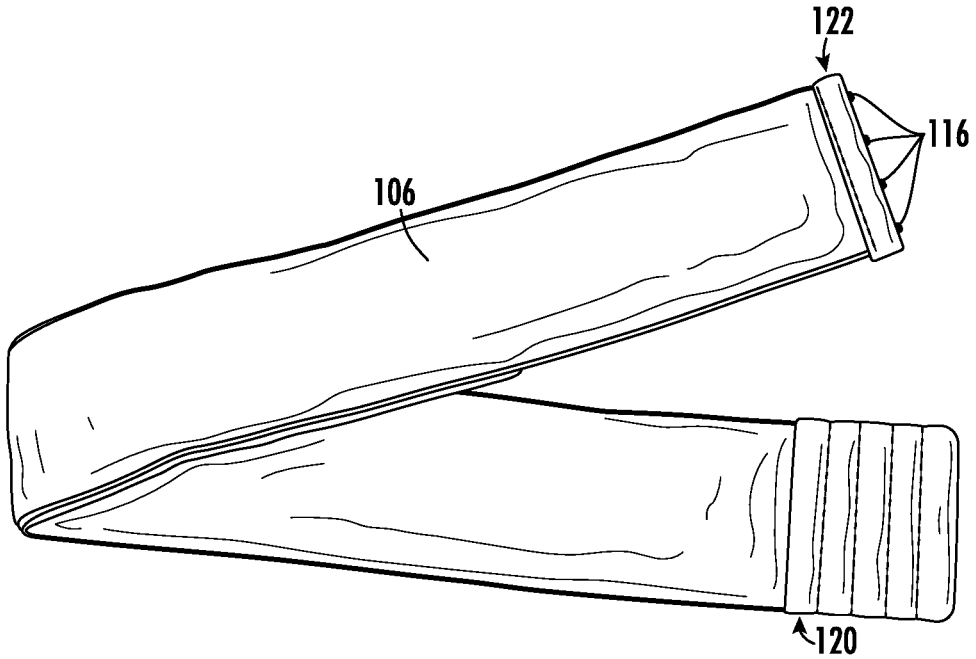

Referring now to FIGS. 5-6, close-up views of the tension member 106 are shown, according to some embodiments. The tension member 106 is shown to include connections 120 and 122 and the fasteners 116 and 118. The connection 120 may include one or more rows of one or more fasteners 118 configured to couple to the fasteners 116 of the connection 112 of the extension member 110 or to the fasteners 116 of the connection 122 of the tension member 106. The one or more rows of the one or more fasteners 118 may act as a structure to facilitate customizing the length of the loop formed by the tension member 106 (and optionally, the extension member 110). For example, to decrease the length of the loop formed by the tension member 106, the user may choose to use the most inward row of the one or more fasteners 118 on the tension member 106.

The connection 120 may include other configurations of fasteners to facilitate customizing the length of the loop formed by the tension member 106. For example, connection 120 may include an adjustable belt. The connection 122 may include one or more fasteners 116 configured to couple to the fasteners 118 of the connection 114 of the extension member 110 or to the fasteners 118 of the connection 120 of the tension member 106.

Figure 7:
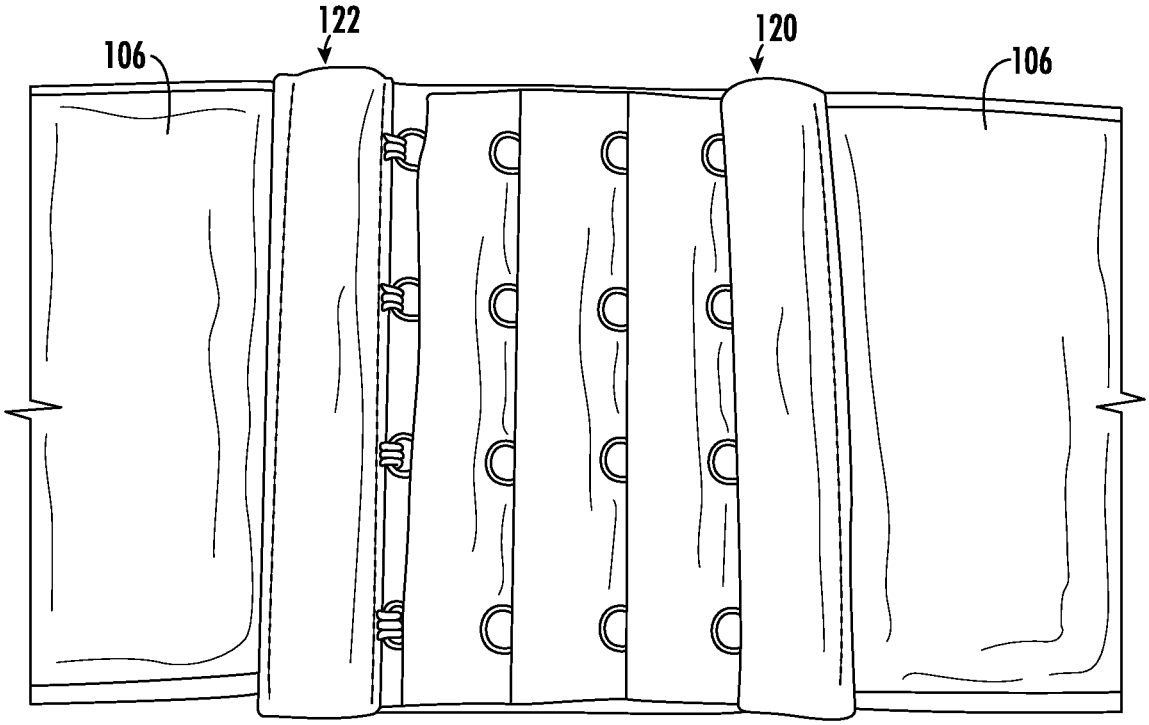
FIG. 7 is a close-up view of connections on either end of the tension member of FIGS. 5-6.
Figure 8:
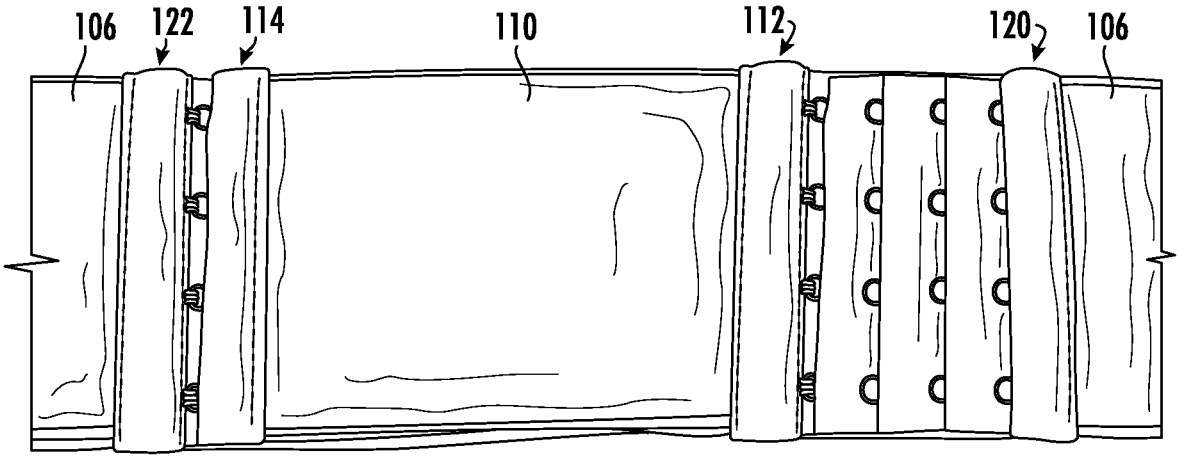
FIG. 8 is a close-up view of the connections on either end of the tension member of FIGS. 5-6 including the tension member extension of FIGS. 3-4.

Referring now to FIGS. 7-8, close up views of the connections 112 and 114 of the extension member 110 and connections 120 and 122 of the tension member 106 are shown, according to some embodiments. More particularly, FIG. 7 shows the tension member 106 at its maximum length coupled at its opposing ends using the most outward fasteners of the connection 120 without the extension member 110, and FIG. 8 shows the tension member 106 at its maximum length coupled at its opposing ends using the most outward fasteners of the connection 120 with the extension member 110 included between its opposing ends.

Referring now to FIGS. 9-12, various views of the exercise device 100 are shown without the tension member 106 or the extension member 110, according to some embodiments. The strap member 104 may be configured to contain and secure the compression member 102 in place. The strap member 104 can include two straps, each forming a loop, coupled (e.g., sewn) together perpendicularly at opposing ends to form a framework.

The strap member 109 can be coupled (e.g., sewn) to the strap member 104 and configured to form a closed loop and receive the tension member 106. The strap member 109 may be used to secure the tension member 106 to the compression member 102 by securing the tension member 106 between the strap members 104 and 109. For example, the strap member 109 may be an elastic strip configured to lay tightly against the strap member 104. The tension member 106 may be held against the compression member 102 by the elastic strip.

Figure 10:
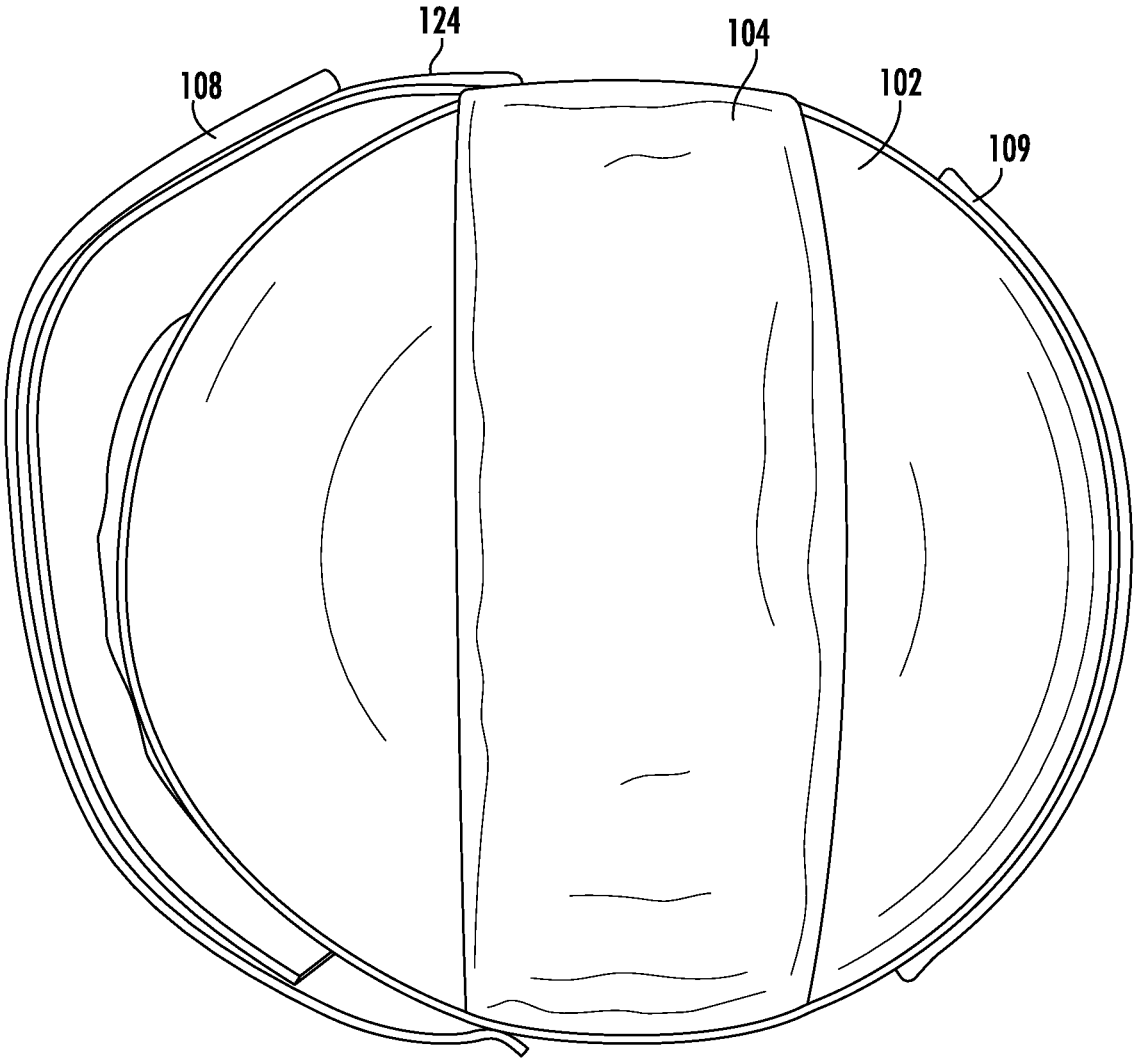
Figure 11:
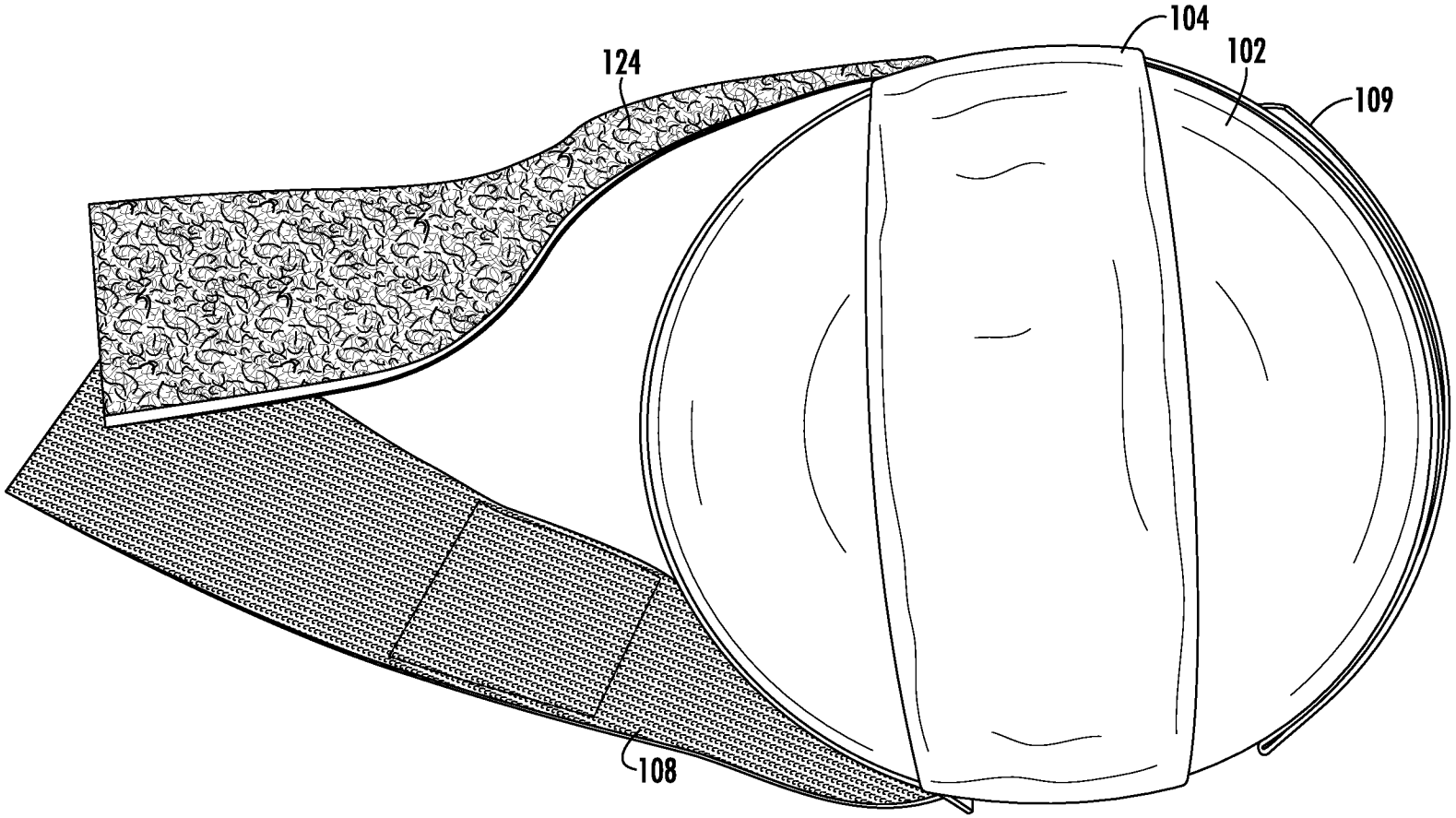
Figure 12:
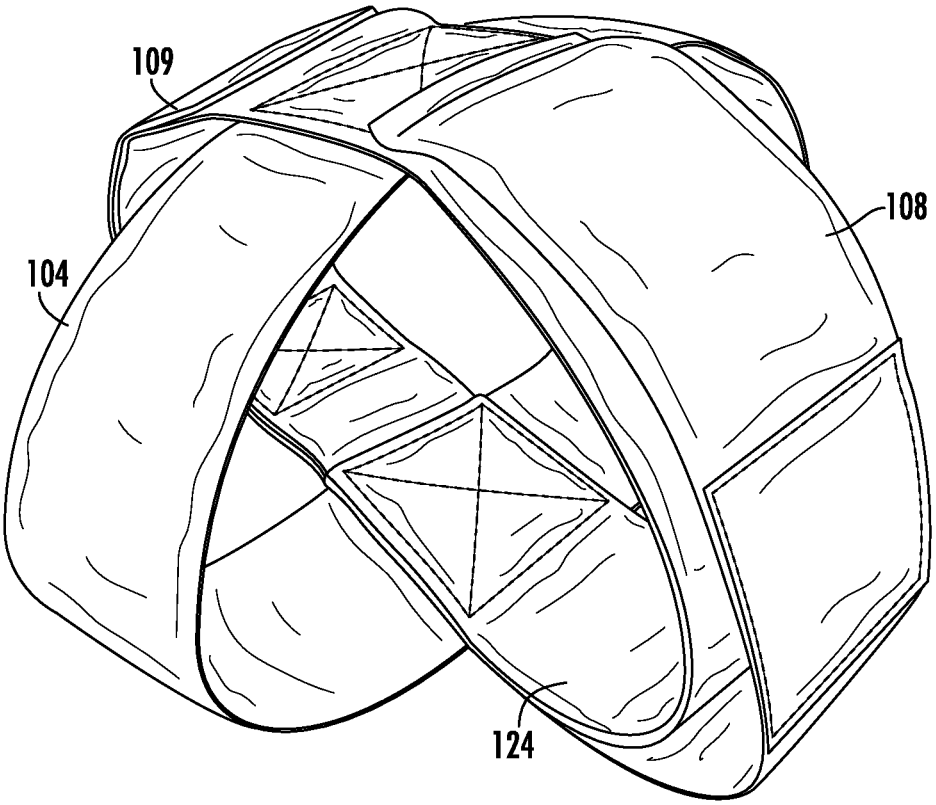
Figure 13:
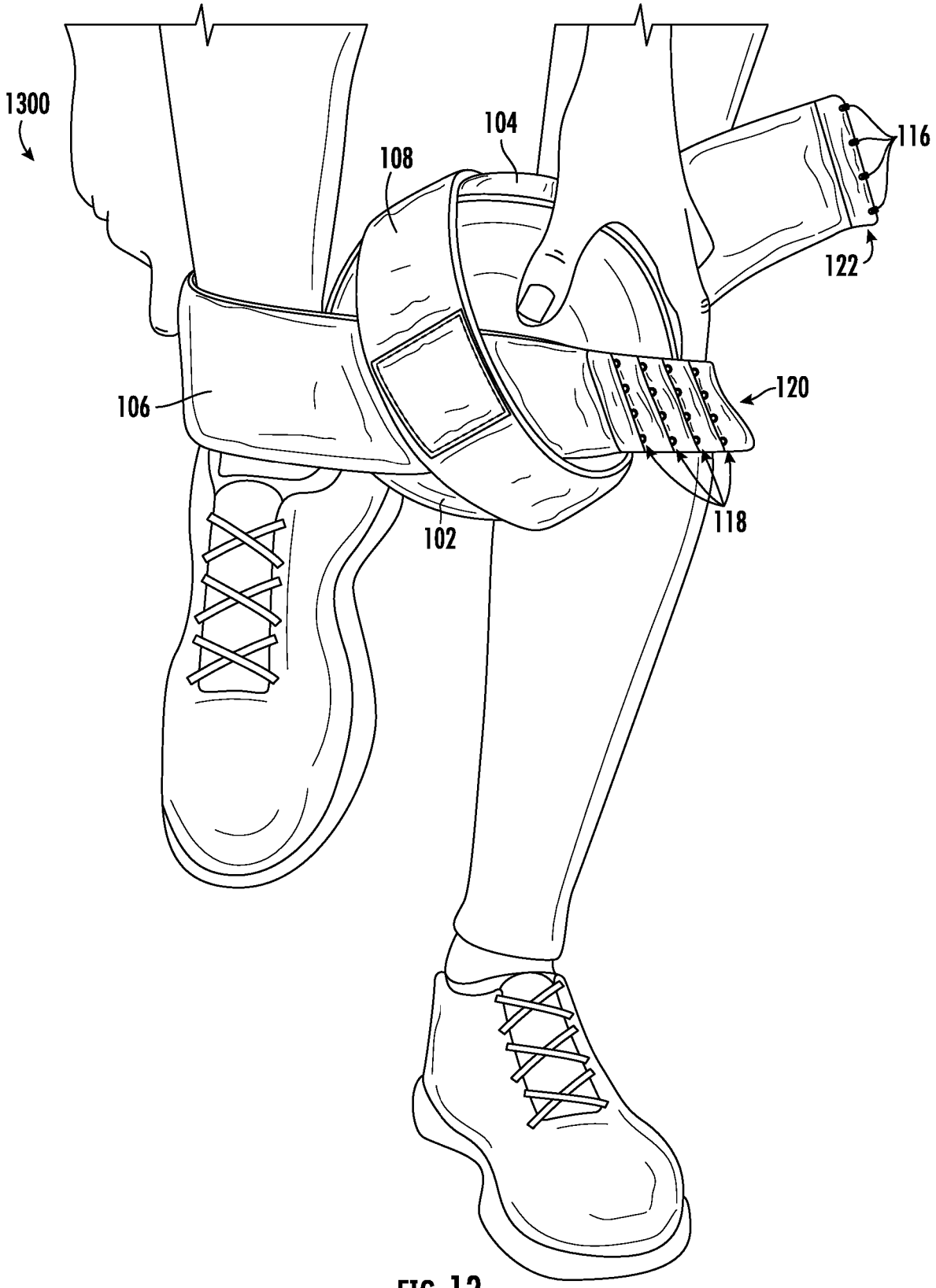
FIGS. 13-18 are illustrations of steps for a user to put on the exercise device of FIG. 1, according to an exemplary embodiment.
Figure 14:
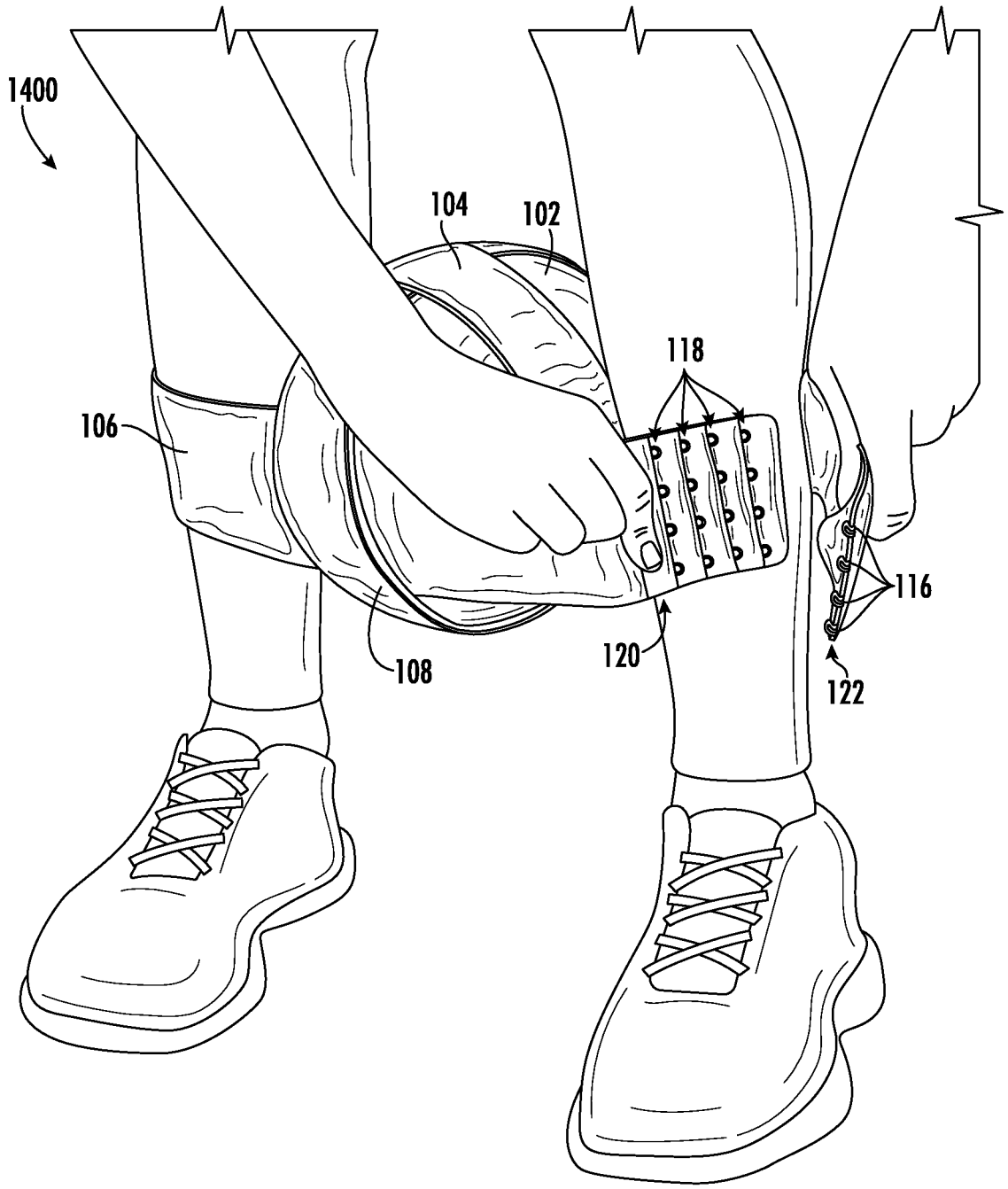
Figure 15:
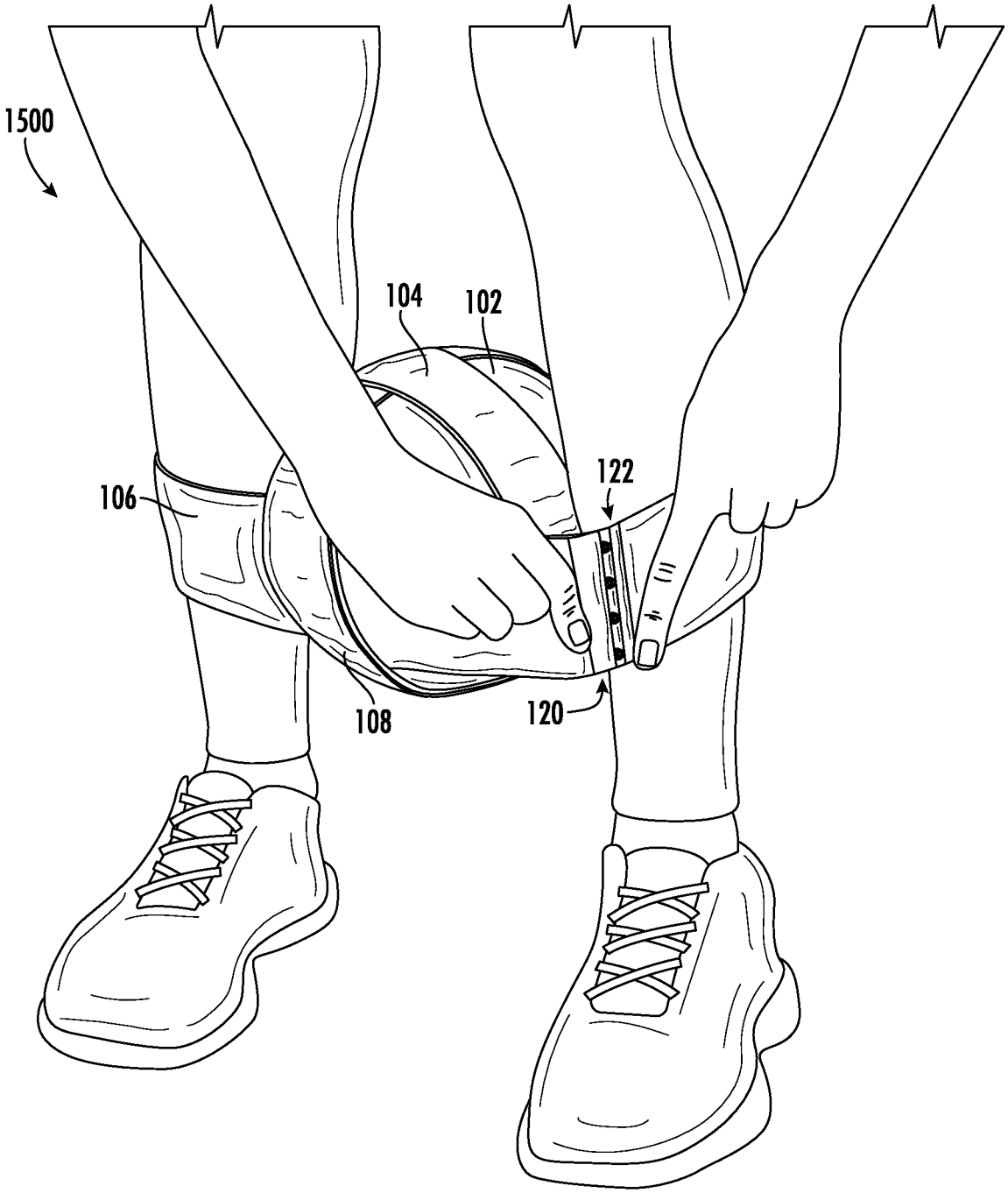
Figure 16:
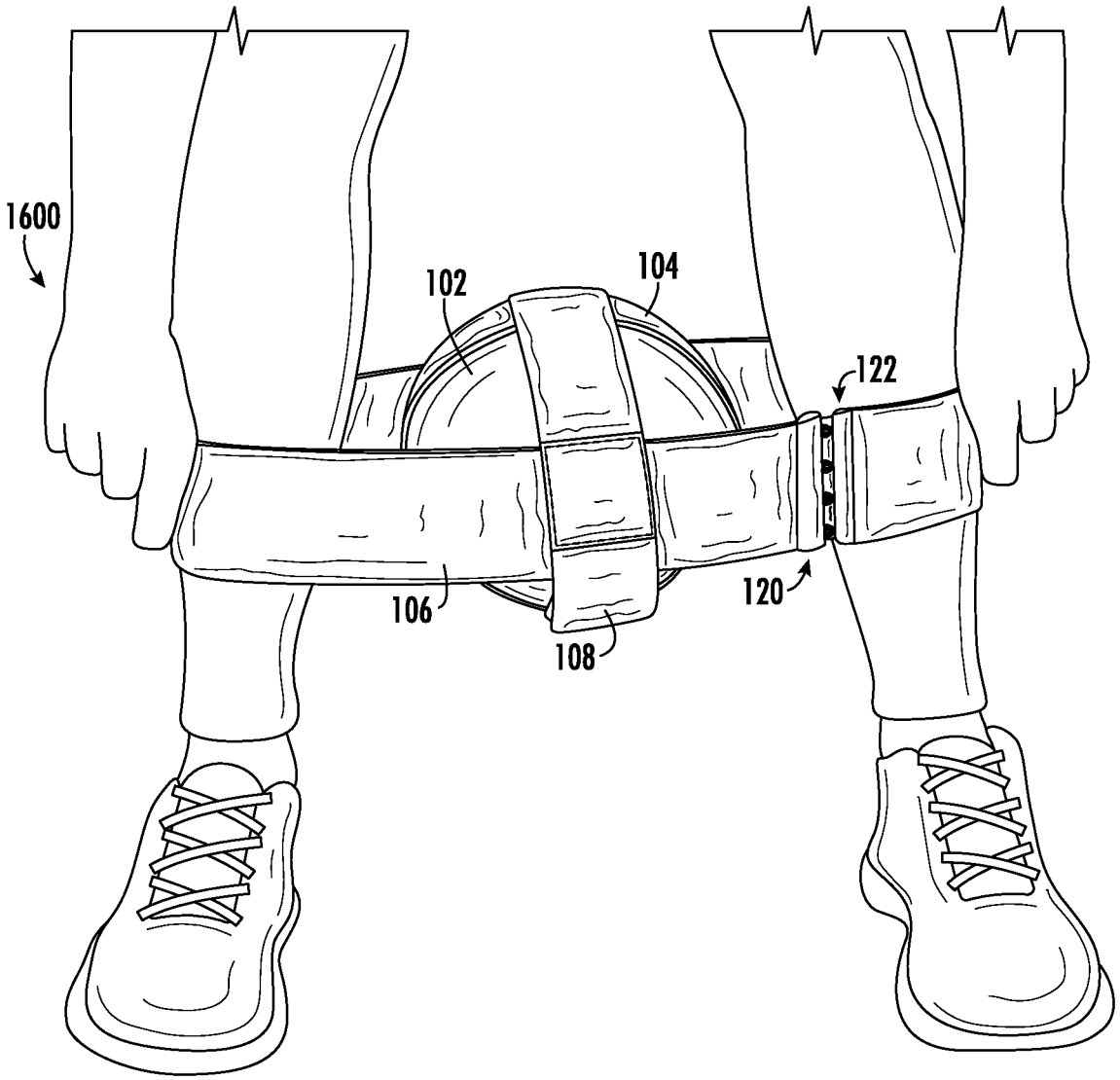
Figure 17:
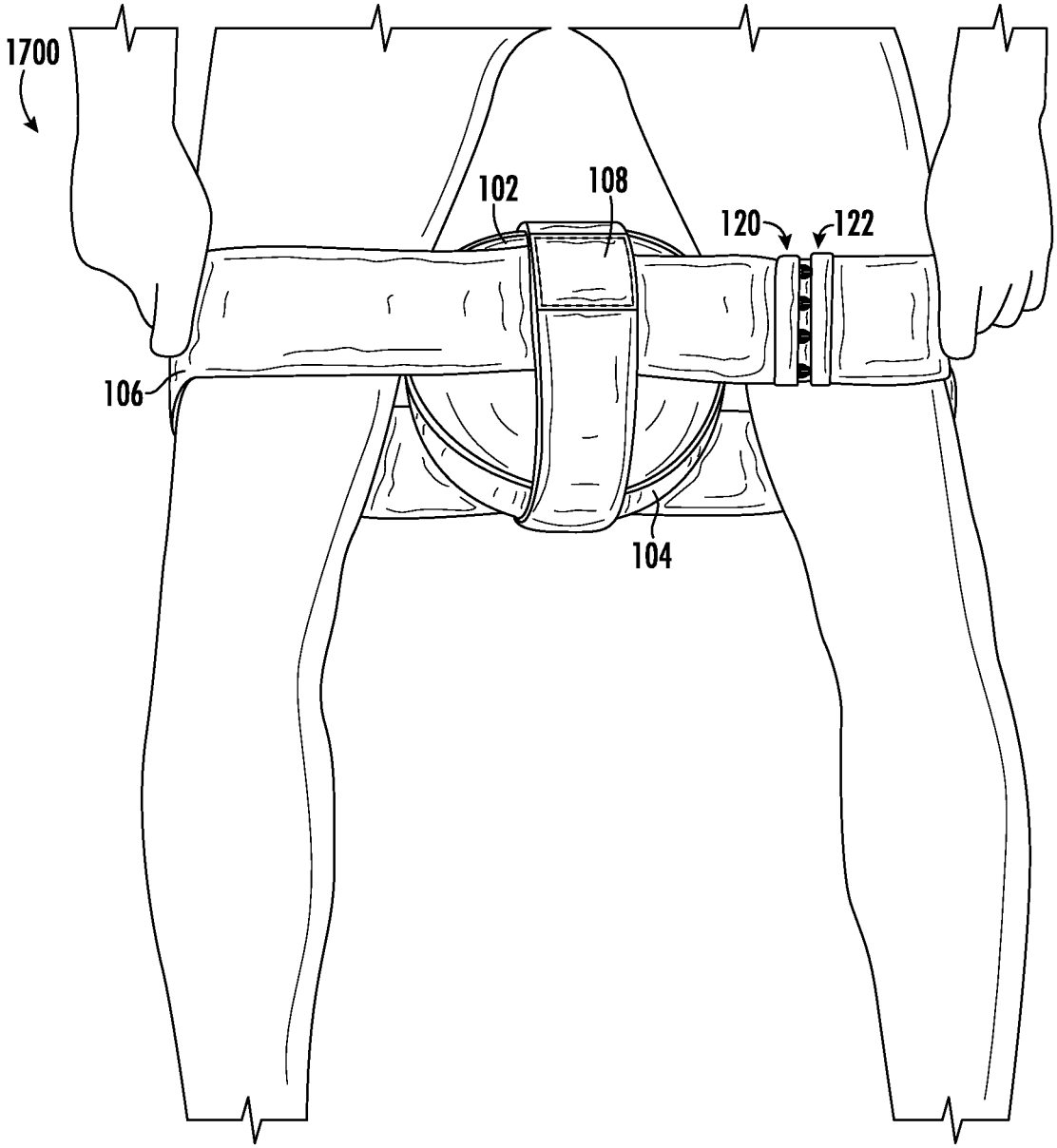
Figure 18:
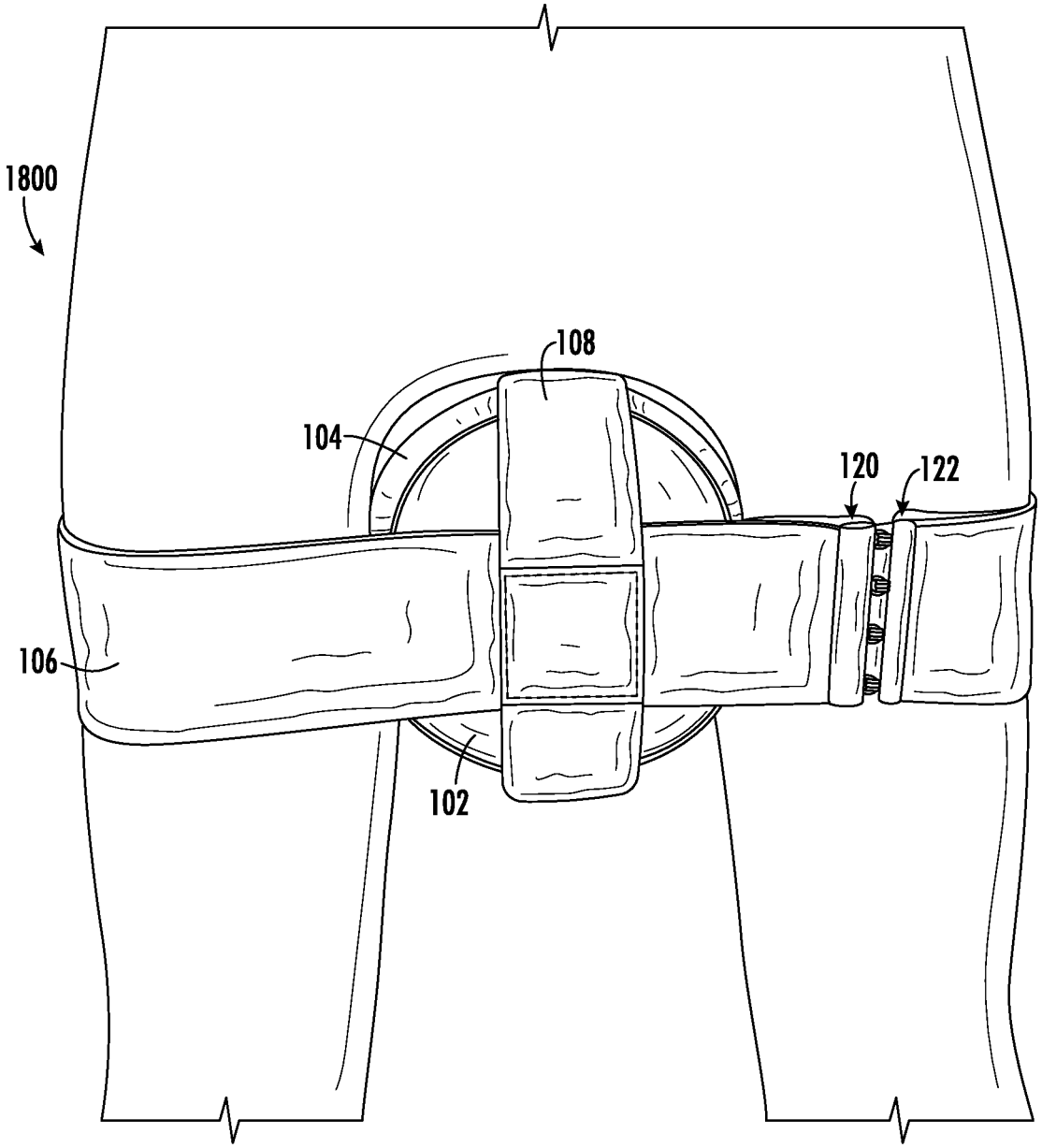

Referring particularly to FIGS. 10-12, the exercise device 100 is shown to include strap member 124. The strap members 108 and 124 can be coupled (e.g., sewn) to the strap member 104. The strap member 124 may be configured to lay under and couple to the strap member 108. The strap members 108 and 124 can be configured to form a closed loop and to secure the tension member 106 to the compression member 102 at an end opposite of the strap member 109. For example, the tension member 106 may be placed between the strap members 108 and 124. The strap members 108 and 124 may include fasteners (e.g., hook-and-loop fasteners) configured to couple the strap members 108 and 124 and secure the tension member 106 between the strap members 108 and 124.

Referring now to FIGS. 13-18, illustrations of steps for a user to put on the exercise device 100 are shown, according to an exemplary embodiment. To put on the exercise device 100, the user may place a foot through a closed portion of the loop formed by the tension member 106 (Step 1300). With the exercise device 100 near ankles of the user, the user may couple the connections 120 and 122 of the tension member 106 together (Steps 1400 and 1500) at a desired length. The user can choose to attach the extension member 110 to the ends of the tension member 106 to increase the size of the loop formed by the tension member 106. The user may then stand with his or her feet at a width apart equal to a width of his or her hips and center the compression member 102 between his or her ankles (Step 1600). The user can then pull the exercise device 100 up his or her legs to position the exercise device 100 (Step 1700). The user can position the exercise device 100 such that the compression member 102 is positioned at a top of the inner thighs of the user (e.g., a groin area of the user) and the tension member 106 is positioned below a top of the outer thighs of the user (Step 1800).

The user may put on the exercise device 100 by following other appropriate steps. For example, the user may couple the opposing ends of the tension member 106 before placing his or her legs through the loop formed by the tension member 106. In another example, the user may place the compression member 102 at the top of his or her inner thighs before coupling the opposing ends of the tension member 106 or before adding the extension member 110. The steps shown and described with reference to FIGS. 13-18 are intended as illustrative only and are not intended to be in any way limiting.

Referring back to FIGS. 3-4, close-up views of the extension member 110 of the exercise device 100 of FIG. 1 are shown. The extension member 110 can also be provided with and used with the embodiment of the exercise device 100 shown in FIG. 19. In some embodiments, the extension member 110 can be any length in the range of exactly or about 3-10 inches in a relaxed or unstretched state. In some embodiments the extension member 110 is exactly or about 5 inches in length in a relaxed or unstretched state. In some embodiments, the extension member 110 is exactly or about 7 inches in length in a relaxed or unstretched state. In some embodiments, the extension member 110 is exactly or about 9 inches in length in a relaxed or unstretched state. In some embodiments, the exercise device 100 can be provided with multiple extension members 110 of different lengths that can be selected by the user and coupled with the tension member 106, 206 to increase the size of the loop formed by the tension member 106, 206 and the extension member 110. The exercise device 100 can be provided with any number of extension members 110. The user may connect one or more extension members 110 to the tension member 106, 206 to customize the length of the loop formed by the tension member 106, 206 and the extension members 110. In some embodiments, the extension members 110 can be provided separate from the exercise device 100 (e.g., provided or offered for sale on their own apart from the exercise device 100). The extension member 110 can either have or not have wave grips similar to the wave grips 228 of tension member 206.

For example, two extension members 110 can be provided together with or without the exercise device 100 where a first extension member 110 is exactly or about 5 inches in length and a second extension member 110 is exactly or about 7 inches in length in a relaxed or unstretched state. In another example, two extension members 110 can be provided together with or without the exercise device 100 where a first extension member 110 is exactly or about 5 inches in length and a second extension member 110 is exactly or about 9 inches in length in a relaxed or unstretched state. In another example, two extension members 110 can be provided together with or without the exercise device 100 where a first extension member 110 is exactly or about 7 inches in length and a second extension member 110 is exactly or about 9 inches in length in a relaxed or unstretched state. In another example, three extension members 110 can be provided together with or without the exercise device 100 where a first extension member 110 is exactly or about 5 inches in length, a second extension member 110 is exactly or about 7 inches in length, and a third extension member 110 is exactly or about 9 inches in length in a relaxed or unstretched state.

Figure 19:
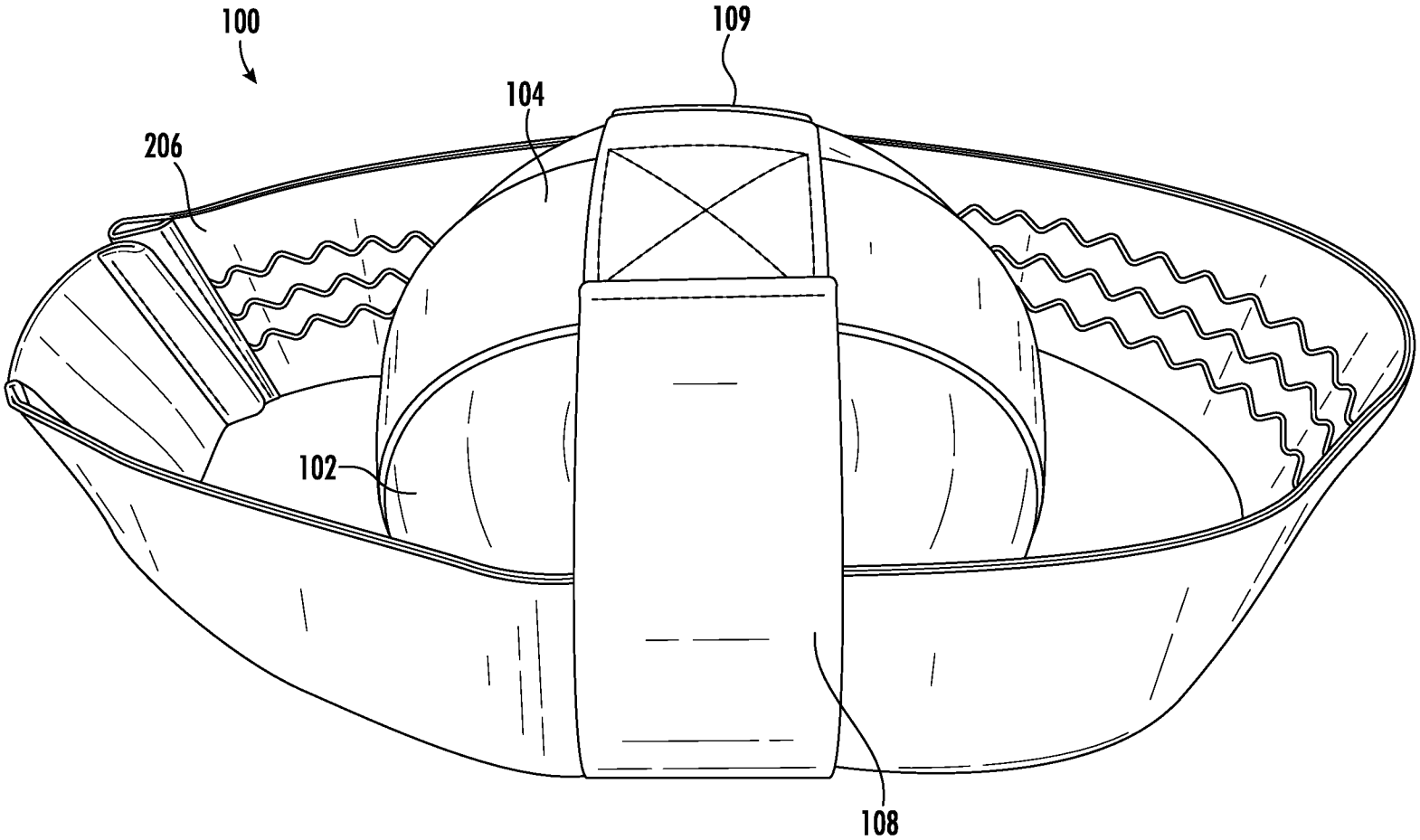
FIG. 19 is a perspective view of another embodiment of the exercise device of FIG. 1 having a tension member with grips, according to an exemplary embodiment.
Figure 20:
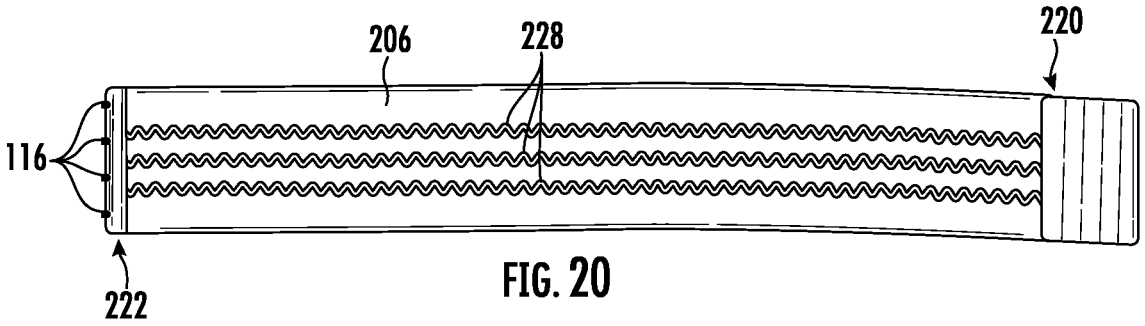
FIG. 20 is a view of an interior-facing surface of the tension member with grips decoupled from the rest of the exercise device of FIG. 19.
Figure 21:
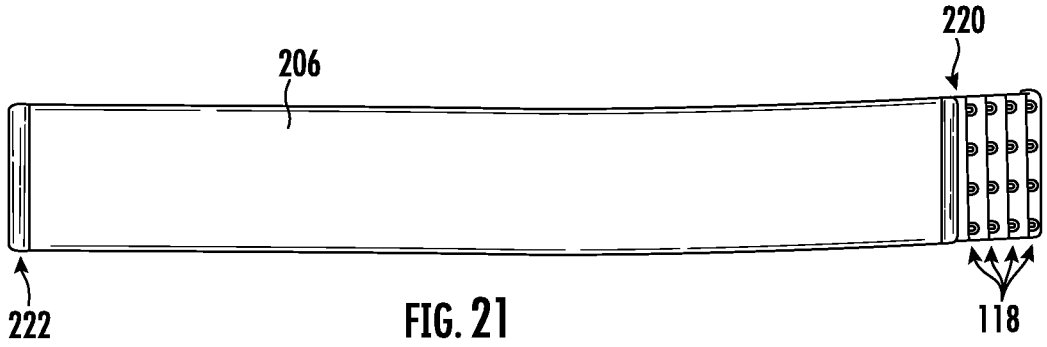
FIG. 21 is an exterior-facing surface of the tension member with grips decoupled from the rest of the exercise device of FIG. 19.
Figure 22:
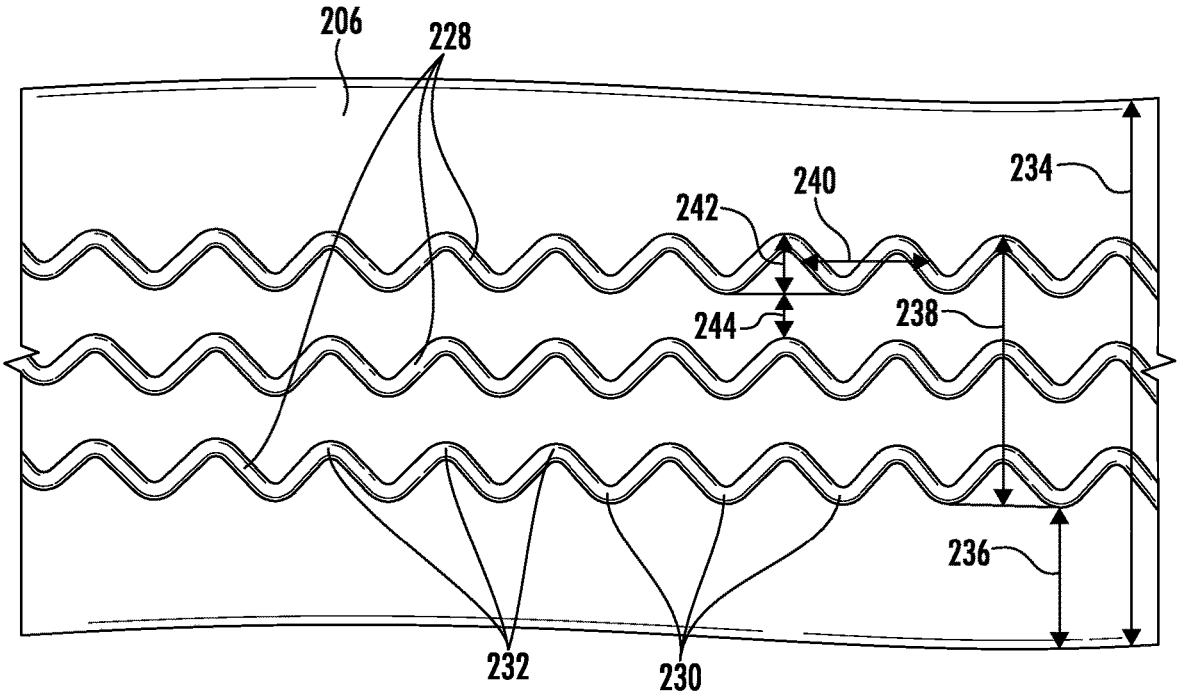
FIG. 22 is a close-up view of the interior-facing surface of the tension member with grips of FIG. 19.

Referring now to FIGS. 19-22, another embodiment of the exercise device 100 is shown along with various views of a tension member 206 with grips 228, according to exemplary embodiments. Specifically, FIG. 19 is a perspective view of another embodiment of the exercise device 100 of FIG. 1 having a tension member 206 with grips 228, FIG. 20 is a view of an interior-facing surface of the tension member with grips 228 decoupled from the rest of the exercise device of FIG. 19, FIG. 21 is an exterior-facing surface of the tension member with grips 228 decoupled from the rest of the exercise device of FIG. 19, and FIG. 22 is a close-up view of the interior-facing surface of the tension member with grips 228 of FIG. 19. As shown, the grips 228 can be wave grips 228 having a wave pattern.

The tension member 206 may be similar to the tension member 106 (e.g., coupled to opposing sides of the compression member 102 and configured to form a loop around the compression member 102 and outer thighs of the user when worn). The tension member 206 may be configured to be worn around outer thighs of the user during performance of an exercise. The user may use his or her outer thighs to apply tensile force (e.g., stretch, extend) to the tension member 206 during an exercise. The tension member 206 can be resilient enough to repeatedly return to an original size and an original shape when the tensile force is removed. Another way to state this property is that the tension member 206 has a "memory".

To be resilient, the tension member 206 may include polyester, (stretch) cotton, elastic, nylon, spandex, or other materials that may be combined to create a fabric capable of stretching and returning to an original size and shape. In some embodiments, the tension member 206 may include a layer made of a single piece (i.e., one layer) of mixed fabric (e.g., a combination of one or more fabrics) that is capable of being repeatedly stretched and yet returns to an original or near original size and shape. For example, the tension member 206 can be made of two pieces of an elastic material with one piece of a latex material in between the two pieces of the elastic material. In another example, the tension member 206 can be a single piece that is made of a solid piece of material that includes a mix of cotton and polyester. The tension member 206 can be thicker than the tension member 106. In some embodiments, the tension member 206 is exactly or about 2/16 of an inch thick or 3/16 of an inch thick. By being made from a single piece of material and being thicker than tension member 106, the tension member 206 is more durable, provides more resistance, and is more aesthetically pleasing than the tension member 106. The tension member 206 may have a length in the range of about 24-36 inches in the relaxed or unstretched state. In some embodiments, the tension member 206 is exactly or about 30 inches in length in a relaxed or unstretched state.

The tension member 206 is further shown to include connections 220 and 222 as well as the fasteners 116 and 118. The connection 220 may include one or more rows of the fasteners 118 which are configured to couple to the fasteners 116 of the connection 112 of the extension member 110 or to the fasteners 116 of the connection 222 of the tension member 206. The one or more rows of the one or more fasteners 118 may act as a structure to facilitate customizing the length of the loop formed by the tension member 206, and optionally, the extension member 110. For example, to decrease the length of the loop formed by the tension member 206, the user may choose to use the most inward row of the one or more fasteners 118 on the tension member 206.

The tension member 206 may further include one or more wave grips 228 located on the inside (e.g., the side of the tension member 206 that is configured to come into contact with the user during use) of the tension member 206. The wave grips 228 are coupled to the tension member 206 and configured to provide a gripping force between the user and the tension member 206. In this way, the wave grips 228 may include one or more materials that are structured to generate high friction when in contact with a user, which improves performance by reducing slippage of the exercise device 100 on the user's legs and holds the exercise device 100 in place when the user performs exercises while wearing the exercise device 100. In one embodiment, the wave grips 228 may be made of silicone, rubber, polyethylene, or other polymers. In one embodiment, the wave grips 228 are made of silicone having a relatively low durometer (e.g., 60 A). In operation, the user may place the tension member 206 around their outer thighs. Once in place, the wave grips 228 come into contact with the outer thighs of the user and grip (e.g., have a high enough friction force to prevent slippage) the user's thighs. Advantageously, the tension member 206 including the one or more wave grips 228 may better stay in place during various exercises involving the exercise device 100. This allows a user to better focus on the exercise at hand and not have to continually adjust or change the position of the tension member 206.

The tension member 206 is shown to include approximately three wave grips 228 that are located centrally (e.g., a same distance from the top end of the tension member 206 to the top wave grip 228 and from the bottom end of the tension member 206 to the bottom wave grip 228), but the tension member 206 may include more or fewer wave grips 228. For example, the tension member 206 may include 1, 2, 3, 4, 5, 6, 7, 8, 9, or 10 or more wave grips 228. Each wave grip 228 may be spaced symmetrically (e.g., the same distance between each wave grip 228) and extend the length of the tension member 206 (e.g., from the connection 222 to the connection 220). The tension member 206 has a width 234 which is the length between the top end and the bottom end of the tension member 206. In some embodiments, the width 234 of the tension member 206 is between exactly or about 2-8 inches, 2-6 inches, or 2-4 inches in the relaxed or unstretched state. In another embodiment, the width 234 of the tension member 206 is exactly or about 3.1875 inches (3 3/16 inches) in the relaxed or unstretched state.

The grips 228 can be arranged on the tension member 206 in various configurations such that the grips 228 can be variously spaced apart from one another and the edges of the tension member 206. For example, in some embodiments, each wave grip 228 includes multiple troughs 230 and crests 232, and each wave grip 228 can be arranged in a central portion of the tension member 206. For example, a wave grip 228 can be arranged a distance 236 from an outside edge (e.g., the top edge or bottom edge) of the tension member 206. The distance 236 is the length from either the top edge of the tension member 206 to the crests 232 of the top wave grip 228, or the bottom edge of the tension member 206 to the troughs 230 of the bottom wave grip 228. In other words, the distance 236 represents the length inward (from the top or bottom edge of the tension member 206) to where a first wave grip 228 is located. In some embodiments, the distance 236 is in the range of about 0.5-1.5 inches in the relaxed or unstretched state. For example, the distance 236 can be exactly or about 0.8125 inches (13/16 inches) when the tension member 206 is in the relaxed or unstretched state. In some embodiments, all three wave grips 228 have a total width 238. The total width 238 is based on the number of wave grips 228, a wave height 242 of each wave grip 228, and a distance 244 between each wave grip 228. In some embodiments, the distance 244 between each wave grip 228 is in the range of about 0.1-0.5 inches when the tension member 206 is in the relaxed or unstretched state, and the wave height 242 is in the range of about 0.1-0.5 inches when the tension member 206 is in the relaxed or unstretched state. For example, the distance 244 can be exactly or about 0.25 inches (¼ inches) when the tension member 206 is in the relaxed or unstretched state. In another example, the wave height 242 can be exactly or about 0.3125 inches (5/16 inches) when the tension member 206 is in the relaxed or unstretched state. Therefore, the total width 238 may be between about 0.5-2.5 inches when the tension member 206 is in the relaxed or unstretched state. For example, the total width 238 can be exactly or about 1.5 inches when the tension member 206 is in the relaxed or unstretched state.

Furthermore, each wave grip 228 is shown to include a wavelength 240. The wavelength 240 is the distance between two corresponding points on adjacent waves, which can include successive points where a wave transitions from up to down, successive crests 232, or successive troughs 230. The total number of both crests 232 and troughs 230 is therefore based on the length of the wave grip 228 and the wavelength 240. In some embodiments, the wavelength 240 of each wave grip 228 is in the range of about 0.1-1.0 inches when the tension member 206 is in the relaxed or unstretched state. In some embodiments, the wavelength 240 of each wave grip 228 is exactly or about 0.5625 inches (9/16 inches) when the tension member 206 is in the relaxed or unstretched state. In this way, the total number of crests 232 and troughs 230 of each wave grip 228 on the tension member 206 may be in the range of about 20-50 of each. By having a relatively small wavelength 240 (and therefore a relatively large number of crests 232 and troughs 230), each wave grip 228 covers a larger surface area and provides a stronger grip (i.e., a stronger friction force) than a wave grip 228 having a relatively larger wavelength 240. While grips 228 are shown as having a wave pattern, it will be appreciated that the grips 228 can be arranged in any style on the tension member 206, such as straight horizontal lines, straight perpendicular lines, a single band or strip, crisscross pattern, triangular pattern, angled lines, and so on. As used herein, the grips 228 collectively may be referred to as the "grip component" and each individual grip 228 may be referred to as being a "grip element."

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above.

What is claimed is:

1. An exercise device comprising:

a resilient compression member configured to be placed between inner thighs of a user and resist a compressive force from the user;

a resilient tension member comprising a grip component having two or more grip elements that each have a wave shape and span at least most of a length of the resilient tension member, wherein each grip element is configured to hold the resilient tension member in place on outer thighs of the user, the resilient tension member configured to:

couple to opposing sides of the resilient compression member, form a first portion of a loop around the resilient compression member and the outer thighs of the user; and resist a tensile force from the user; and an extension member detached from the resilient compression member and configured to connect with opposing ends of the resilient tension member to form a second portion of the loop, wherein the extension member comprises at least one of an elastic material, a latex material, or other stretchable material.

2. The exercise device of claim 1, wherein the resilient tension member comprises a single layer of material and the grip component.

3. The exercise device of claim 2, wherein the material includes cotton and polyester.

4. An exercise device comprising:

a resilient compression member configured to resist a compressive force from a user;

a resilient tension member comprising a grip component having two or more grip elements that each have a wave shape and span at least most of a length of the resilient tension member, wherein each grip element is configured to hold the resilient tension member in place on the user, and wherein the resilient tension member includes a single layer of a material that has a thickness in the range of 0.125 and 0.1875 inches, the resilient tension member configured to:

couple to opposing sides of the resilient compression member;

form a first portion of a loop around the resilient compression member and the user; and resist a tensile force from the user; and an extension member detached from the resilient compression member and configured to connect with opposing ends of the resilient tension member to form a second portion of the loop, wherein the extension member comprises at least one of an elastic material, a latex material, or other stretchable material.

5. The exercise device of claim 4, wherein the two or more grip elements span from a first connection to a second connection of the resilient tension member.

6. The exercise device of claim 1, wherein the grip component is made of silicone.

7. The exercise device of claim 1, wherein the grip component is disposed along a user-facing surface of the resilient tension member.

8. The exercise device of claim 1, wherein the two or more grip elements span from a first connection to a second connection of the resilient tension member.

9. The exercise device of claim 1, wherein the wave shape of each grip element has a plurality of troughs and crests.

10. The exercise device of claim 1, wherein the extension member has a length in a range of 4-10 inches when the extension member is in a relaxed or unstretched state.

11. The exercise device of claim 4, wherein the grip component comprises three or more grip elements that each have a wave shape and span at least most of the length of the resilient tension member.

12. The exercise device of claim 11, wherein the grip component is arranged along a center area of the resilient tension member.

13. The exercise device of claim 12, wherein the center area is exactly or about 1.5 inches wide.

14. The exercise device of claim 11, where the first grip element is offset from the second grip element.

15. The exercise device of claim 11, wherein the wave shape of each grip element has a plurality of troughs and crests.

16. An exercise device comprising:

a resilient compression member configured to resist a compressive force from a user and comprising a compressible object having a rounded or sphere-like shape; and a resilient tension member comprising a grip component having two or more grip elements that each span at least most of a length of the resilient tension member, wherein each grip element is configured to hold the resilient tension member in place on the user and has a wave shape, and wherein the resilient tension member includes a single layer of a material that has a thickness in the range of 0.125 and 0.1875 inches, the resilient tension member configured to:

couple to the resilient compression member;

form a first portion of a loop around the resilient compression member and the user; and resist a tensile force from the user; and an extension member detached from the resilient compression member and configured to connect with opposing ends of the resilient tension member to form a second portion of the loop, wherein the extension member comprises at least one of an elastic material, a latex material, or other stretchable material.

17. The exercise device of claim 16, wherein the resilient tension member forms the first portion of the loop, and the extension member forms the second portion of the loop.

18. The exercise device of claim 16, wherein each grip element includes a plurality of troughs and crests, and wherein a distance between the troughs and crests is in a range of 0.1-0.5 inches when the resilient tension member is in a relaxed or unstretched state.

19. The exercise device of claim 16 wherein each grip element has a wavelength in the range of 0.4-1.0 inches when the resilient tension member is in a relaxed or unstretched state.

20. The exercise device of claim 16, wherein a distance between each grip element is in the range of 0.1-0.5 inches when the resilient tension member is in a relaxed or unstretched state.

* * * * *